US008344830B2

(12) United States Patent
Petzold et al.

(10) Patent No.: US 8,344,830 B2
(45) Date of Patent: Jan. 1, 2013

(54) MAGNET CORE; METHOD FOR ITS PRODUCTION AND RESIDUAL CURRENT DEVICE

(75) Inventors: Joerg Petzold, Kahl (DE); Markus Brunner, Bessenbach (DE)

(73) Assignee: Vaccumschmelze GmbH & Co. KG, Hanau (DE)

( * ) Notice: Subject to any disclaimer, the term of this patent is extended or adjusted under 35 U.S.C. 154(b) by 103 days.

(21) Appl. No.: 12/670,116

(22) PCT Filed: Jul. 17, 2008

(86) PCT No.: PCT/EP2008/005877

§ 371 (c)(1),
(2), (4) Date: Jun. 7, 2010

(87) PCT Pub. No.: WO2009/012938

PCT Pub. Date: Jan. 29, 2009

(65) Prior Publication Data

US 2010/0265016 A1 Oct. 21, 2010

(30) Foreign Application Priority Data

Jul. 24, 2007 (DE) ..... 10 2007 034 532

(51) Int. Cl.
*H01H 75/00* (2006.01)

(52) U.S. Cl. ..... 335/6; 156/188; 156/275.5

(58) Field of Classification Search ..... 335/6, 281, 335/297; 156/188, 275.5; 336/233–234
See application file for complete search history.

(56) References Cited

U.S. PATENT DOCUMENTS

| | | | | |
|---|---|---|---|---|
| 4,648,929 | A * | 3/1987 | Siman | 156/188 |
| 2001/0031837 | A1 | 10/2001 | Perez et al. | |
| 2006/0105664 | A1* | 5/2006 | Zafiroglu | 442/402 |
| 2007/0089809 | A1* | 4/2007 | Itoh et al. | 148/312 |
| 2007/0273467 | A1* | 11/2007 | Petzold et al. | 336/234 |
| 2009/0206975 | A1* | 8/2009 | Nuetzel et al. | 336/233 |
| 2011/0126975 | A1* | 6/2011 | Fujisawa et al. | 156/275.5 |
| 2011/0203027 | A1* | 8/2011 | Flather et al. | 2/48 |

FOREIGN PATENT DOCUMENTS

| | | | |
|---|---|---|---|
| DE | 4210748 | C1 | 12/1993 |
| DE | 69714103 | T2 | 9/1997 |
| DE | 69810551 | T2 | 3/1999 |
| EP | 0392204 | A2 | 10/1990 |

(Continued)

OTHER PUBLICATIONS

International Search Report dated Nov. 26, 2008 for International Application No. PCT/EP2008/005877.

(Continued)

*Primary Examiner* — Bernard Rojas
(74) *Attorney, Agent, or Firm* — Buchanan Ingersoll & Rooney PC

(57) ABSTRACT

A magnet core (1) that is suitable for use in a fault current circuit breaker and that is made of a helically wound, magnetically soft band has a top (4) and a bottom (5), the top (4) and the bottom (5) being formed by side surfaces (16) of the magnetically soft band. The magnet core (1) is fixed in a protective housing (6), and there is a contact cement (11) between the bottom (5) of the magnet core (1) and an inside wall (10) of the housing for fixing the magnet core (1).

40 Claims, 5 Drawing Sheets

FOREIGN PATENT DOCUMENTS

| | | | |
|---|---|---|---|
| EP | 0509936 | A2 | 10/1992 |
| EP | 0509936 | B1 | 10/1992 |
| EP | 0794541 | A1 | 9/1997 |
| JP | 63115313 | A | 5/1988 |
| JP | 03-019307 | | 1/1991 |
| WO | WO03007316 | A2 | 1/2003 |

OTHER PUBLICATIONS

Callister, Jr., "Materials Science and Engineering" John Wiley & Sons, Inc., Chapter 6, pp. 128-129.

* cited by examiner

MAGNET CORE; METHOD FOR ITS PRODUCTION AND RESIDUAL CURRENT DEVICE

BACKGROUND

1. Field

Disclosed herein is a magnet core that is wound from a magnetically soft band. Also disclosed is to a method for producing such a magnet core and a fault current circuit breaker with a magnet core.

2. Description of Related Art

Magnet cores that are formed from a helically wound metal band, so-called ring band cores, are used in, for example, current transformers, power transformers, current-compensated radio interference suppression reactors, starting current limiters, storage reactors, single-conductor reactors, half-cycle transductors, and sum or difference current transformers for FI circuit breakers.

High demands are imposed on these cores with respect to magnetic properties: fault current transformers for AC-sensitive fault current circuit breakers, for example, must make available a secondary voltage that is at least enough to trigger the magnet system of the trigger relay that is responsible for shut-off. Since a design of a current transformer that saves as much space as possible is desired it is generally desirable that, a material for the magnet core high induction at the typical working frequency of 50 Hz, and also has a relative permeability $\mu_r$ that is as high as possible. The geometry of the magnet core and the material properties, in combination with the technological upgrading and processing of the material, for example by heat treatment, have a major influence on the relative permeability.

In the past, to achieve comparatively high relative permeabilities, it was necessary to achieve a saturation magnetostriction constant $\lambda_s$ of $|\lambda_s|<2$ ppm, or even <0.3 ppm, and that was as small as possible. Moreover, bands that were as geometrically perfect as possible with as few defects of form as possible were an important prerequisite. However, it is only possible to easily achieve such a small saturation magnetostriction constant $\lambda_s$ with only a few alloys. Moreover, for industrial production, it is almost impossible to achieve a sufficiently exact alloy composition without impurities.

It would, however, be possible to achieve high relative permeabilities with numerous other alloy compositions if the magnet core were free of mechanical stresses. Mechanical stresses are, for example, introduced into the magnet core when the core is wound from one or more bands or in its later handling or processing. The relationship between the absence of stresses in the magnet core and the high relative permeability is addressed in, for example, JP 63-115313. While stresses that have formed during winding can generally be greatly reduced in subsequent heat treatment, the delivery of mechanical stresses by external effects such as impacts or shaking must be avoided as much as possible.

For this purpose, for example, EP 0 509 936 B1 discloses connecting a magnet core made of a nickel iron alloy to a housing by means of a soft-elastic silicone cement by several bonding points. This process cannot, however, be transferred to a magnet core made of a magnetostrictive alloy since before complete crosslinking of silicone cement, it creeps as a result of capillary forces and the inherent weight of the magnet core between the band layers of the magnet core. Defects of form in amorphous and nano crystalline bands promote penetration of the cement. Upon curing, tensile stresses result on the crosslinked band layers, and thus the magnetic properties of the core are degraded. Since the intensity of penetration of the silicone cement between the band layers depends largely on randomly occurring defects of form, this effect can, moreover, only be predicted with difficulty and leads to serious variance of the permeability values.

SUMMARY

Accordingly, there remains a need to devise a magnet core that is wound from a magnetically soft band that is effectively protected against externally applied mechanical stresses and thus has permanently good magnetic properties.

There also remains a need to devise a method for producing such a magnet core.

In a particular embodiment is disclosed a magnet core assembly, comprising: a magnet core formed from a magnetically soft band that is helically wound to form a plurality of band layers separated by intermediate spaces, and having side surfaces thereof, wherein the magnet core comprises a top and a bottom, wherein the top and the bottom are formed by a side surface of the magnetically soft band; a protective housing comprising an inside wall disposed around the magnet core, and within which the magnet core is fixed; and a tacky contact cement disposed between the bottom of the magnet core and the inside wall of the protective housing for fixing the magnet core therein.

In another embodiment is disclosed a method for producing a magnet core assembly, comprising: providing a magnet core wound from a magnetically soft band to form a plurality of band layers separated by intermediate spaces, and having side surfaces thereof, wherein the magnet core comprises a top and a bottom, wherein the top and bottom are formed by a side surface of the magnetically soft band; providing a protective housing comprising an inside wall, and adapted for holding the magnet core; applying a contact cement to the inside wall of the protective housing, wherein the contact cement forms a tacky film on its surface; inserting the magnet core into the protective housing, such that the bottom of the magnet core contacts and adheres to the contact cement.

These needs and others are satisfied by embodiments of a magnet core disclosed herein, wherein the magnet core is made of a helically wound, magnetically soft band with a top and a bottom, the top and the bottom being formed by side surfaces of the magnetically soft band, the magnet core being fixed in a protective housing and there being a contact cement between the bottom of the magnet core and the inside wall of the housing for fixing the magnet core.

Without wishing to be bound theory, it is believed that, especially for magnet cores of quickly solidified alloys, a nonpositive connection between the protective housing and the magnet core can be avoided since these band layers have low inherent stability. As a result, tensile forces caused by shrinking of the volume of the cement necessarily deliver mechanical stresses into the magnet core. Therefore, impregnation of the magnet core with the cement should be prevented. A nonpositive connection between the magnet core and protective housing would result in differences in thermal expansion between the material of the magnet core and that of the housing, which make themselves noticeable directly by mechanical deformations. Due to the fundamental relationship $$\mu_r \propto \frac{1}{\lambda_s \cdot \sigma}$$

between the relative permeability $\mu_r$, the saturation magnetostriction constant $\lambda_s$ and the mechanical stress $\sigma$, these deformations lead to overly small and, moreover, highly varying relative permeabilities when the saturation magnetostriction constant is not small enough.

By using a contact cement that has a tacky surface after drying, however, it is possible to fix the magnet core in the protective housing in a way that is at the same time elastic enough to equalize stresses can be achieved. Moreover, in the embodiments disclosed herein the penetration of the contact cement between the band layers can be minimized, so that the coupling of the magnet core to the housing taking place almost solely via adhesion of the cement to the side surfaces of the individual band layers. Suitable cements are, for example, soft-elastic, thermoplastic contact cement masses.

BRIEF DESCRIPTION OF DRAWINGS

Embodiments of the method and apparatus described herein are presented in more detail below with reference to the attached figures which are not intended to limit the scope of the claims.

DETAILED DESCRIPTION OF SPECIFIC EMBODIMENTS

Figure 1:
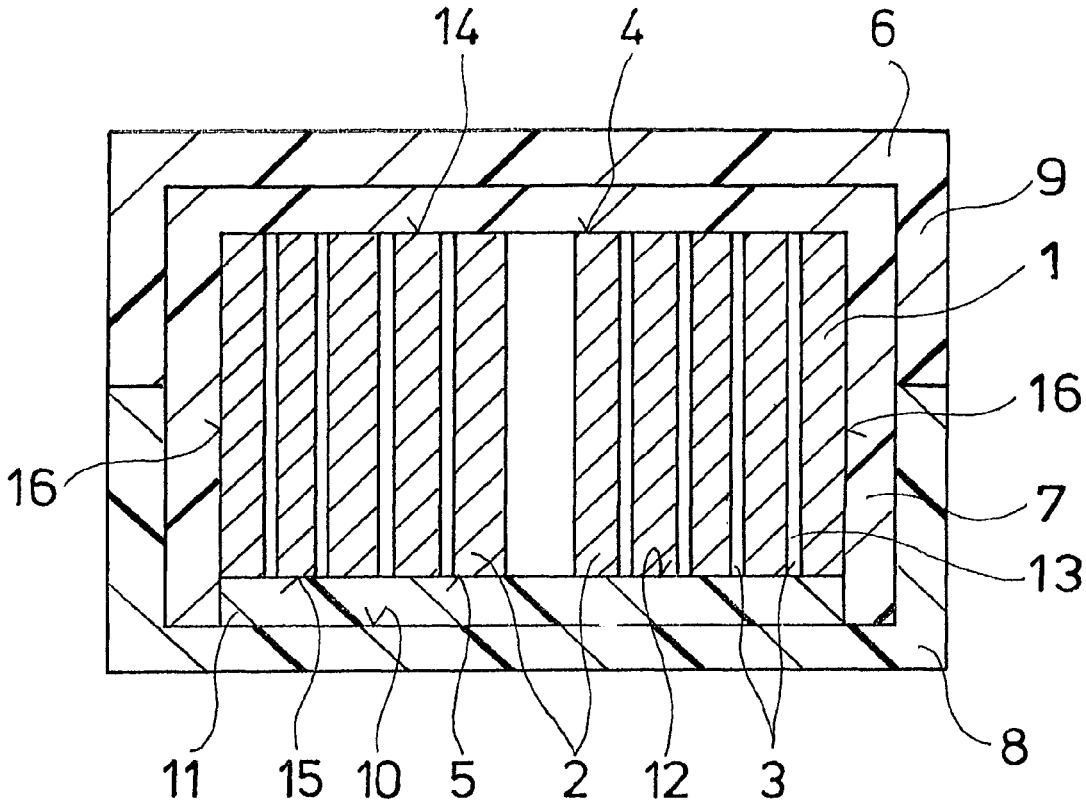
FIG. 1 is a diagram that schematically shows one embodiment of the magnet core described herein.

In one advantageous embodiment, the contact cement has an acrylate polymer. Compared to other fundamentally suitable contact cement masses such as, for example, based on rubber, polyvinyl ester, polybutadiene or polyurethane, those based on acrylate polymers have the advantage that they allow the formulation of especially resistant cement masses.

In one advantageous embodiment, the contact cement has an elongation at tear, $\epsilon_R$, such that $\epsilon_R$>250%, preferably >450%, furthermore preferably >600%. These contact cements are relatively elastic in order to prevent unwanted force transfer between the housing and the magnet core that has been fixed in it. Furthermore, the contact cement advantageously has a glass transition temperature $T_g$, such that $T_g$<0° C.; more desirably $T_g$<−20° C.; even more desirably $T_g$<−30° C., and a melting point $T_s$ such that $T_s$>180° C.

The penetration depth t of the contact cement between the band layers of the magnet core in one advantageous embodiment is t<2 mm, preferably t<0.5 mm and, furthermore, preferably t<0.01 mm.

Typically, the finished magnet core, therefore the magnet core after completion of heat treatment, has a nanocrystalline magnetically soft band. Depending on the application of the magnet core, however, amorphous or crystalline bands are also possible.

For the magnet core according to an embodiment described herein, different alloy compositions are possible. Because it is not necessary, using the techniques described herein, to make the saturation magnetostriction constant disappear, current iron based alloys can be used. In addition, residual impurities that, in general, cannot be completely avoided are able to be tolerated, without the occurrence of unwanted influences on the magnetic properties.

In one embodiment, the magnetically soft band, in addition to commercially common impurities of raw materials and the melt, has essentially the following alloy composition:

$$Fe_aCo_bCu_cSi_dB_eM_fX_g$$

in which M is at least one of the elements V, Nb, Ta, Ti, Mo, W, Zr, and Hf, and X is at least one of the elements P, Ge and C; a, b, c, d, e, and f are given in atomic percent, wherein $0 \leqq b \leqq 45$; $0.5 \leqq c \leqq 2$; $6.5 \leqq d \leqq 18$; $5 \leqq e \leqq 14$; $1 \leqq f \leqq 6$; d+e>16; g<5, and a+b+c+d+e+f+g=100. Cobalt can be replaced here in whole or in part by nickel.

In one advantageous embodiment, the magnet core has a saturation magnetostriction constant $\lambda_s$, such that $\lambda_s$<15 ppm, in particular $|\lambda_s|$<15 ppm.

The ratio of remanent induction to saturation induction $B_R/B_S$ of the magnet core is advantageously $B_R/B_S$>45%, and the maximum permeability $\mu_{max}$>250,000, for example, after heat treatment in the absence of a magnetic field for nanocrystallization. In one alternative embodiment, the magnet core has a ratio of remanent induction to saturation induction $B_R/B_S$ of $B_R/B_S$>50% and a maximum permeability $\mu_{max}$, such that $\mu_{max}$>150,000. These properties can be achieved by, for example, direct-axis field treatment following heat treatment for nanocrystallization. In another alternative embodiment, $B_R/B_S$>2% and $\mu_{max}$>5,000. These properties can be achieved by, for example, quadrature-axis field treatment following heat treatment for nanocrystallization.

An embodiment of method described herein for producing a magnet core has at least the following steps: first of all, a magnet core with a top and a bottom that is wound from a magnetically soft band is made available; wherein the top and bottom of the magnet core are formed by the side surfaces of the magnetically soft band. Furthermore, a protective housing for holding the magnet core is made available. A contact cement is applied to the inside wall of the housing, the contact cement forming a film on its surface. After the film forms, the magnet core is inserted into the protective housing, the bottom of the magnet core being brought into contact with the contact cement and adhering to it.

In one advantageous embodiment, the contact cement is applied as an aqueous dispersion to the inside housing wall. In one alternative embodiment, the contact cement is applied as an organic solution. The use of an aqueous dispersion has the advantage that film formation begins on the surface, while drying in the lower layers of the cement mass takes place delayed in time by diffusion of the water contained in the dispersion through the film that has already formed.

Advantageously, the contact cement has not yet set when the magnet core is inserted into the protective housing under the film on its surface. Thus, especially when the contact cement has a viscosity $\nu$, such that $\nu$<20 Pa·s when the magnet core is inserted into the protective housing, it is ensured that the film on the surface, on the one hand, is strong enough to prevent tearing of the film as the cement penetrates between the band layers, while, on the other hand, the remaining, still thin-liquid dispersion amount enables deformation of the cement droplet under the individual weight of the magnet core and deformation-free sinking of the magnet core into the cement mass.

After application, the contact cement is advantageously subjected to drying by hot air or infrared heating or exposure to other heat-forming radiation, film formation starting on the surface of the cement.

In one advantageous embodiment, the contact cement has a solid content of more than 30 percent by weight and a minimum film formation temperature $T_F$, such that $T_F<0°$ C. when the magnet core is inserted into the protective housing.

The magnet core is typically subjected to heat treatment before insertion into the protective housing. This heat treatment can, on the one hand, reduce mechanical stresses that result from the winding of the magnet core. On the other hand, in the originally amorphous band, a nanocrystalline or crystalline structure can be set. Heat treatment is advantageously done at a temperature T with 505° C.≦T≦600° C. To set a nanocrystalline structure, however, somewhat lower temperatures of, for example, 480° C. are also possible. In one embodiment, the heat treatment is carried out free of fields in the absence of a magnetic field. To set the desired magnetic properties, the magnet core can, however, also be exposed to a magnetic field of a certain direction (for example, quadrature-axis or direct-axis field) and intensity during heat treatment.

The magnet core according to embodiments described herein is especially suitable for use in a fault current circuit breaker. Due to its high relative permeability, a sufficiently high secondary voltage is made available that is sufficient to trigger the magnet system of the trigger relay that is responsible for shutoff. Applications, for example as current transformers, transformers or chokes with different hysteresis curves, are also possible.

The magnet core 1 according to FIG. 1 is made as a ring band core and is wound from a magnetically soft band. It has a number of band layers 2 that are separated from one another by intermediate spaces 3. The front sides 14 and 15 of the band layers 2 form the top 4 and the bottom 5 of the magnet core 1.

The magnet core 1 is embedded in a protective housing 6 that in the illustrated embodiment consists of an inner protective tank 7 that is turned down over the magnet core 1, and an upper shell 9 and lower shell 8 that hold the protective tank 7. The magnet core 1 is protected by the protective housing against external influences that could deliver mechanical deformations into the band layers 2. The upper shell 9 can also be made as a flat cover.

The magnet core 1 is fixed in the protective housing 6 using a layer of contact cement 11. The contact cement 11 is located on the inside wall 10 of the protective housing 6 and has a tacky surface 12 with which the front sides 15 of the band layers 2 are in adhesive contact on the bottom 5 of the magnet core. The contact cement 11, however, does not penetrate or penetrates only very slightly into the lower region 13 of the intermediate spaces 3. It is, moreover, elastic enough so that transfer of tensile stresses that are caused by the contact cement 11 to the band layers 2 is reliably prevented.

In the illustrated embodiment, only the bottom 5 of the magnet core 1 is fixed by a single cement layer on the inside wall 10 of the housing. It is also possible, however, to fix, for example, the side surfaces 16 and/or the top 4 of the magnet core 1 on the protective housing 6 by a contact cement.

As has been ascertained, in the illustrated type of fixing, an amount of cement of 2 drops with an average diameter of roughly 1.5 to 3 mm with a mass of the drops of at least 0.05 to 0.3 g (that is dependent on the solid content of the cement) is generally sufficient. For typical magnet cores, thus a bonding point can be produced that does not cover the entire bottom 5 of the magnet core 1, as is shown in FIG. 1. The bonding point then has a surface area of at least 15 $mm^2$, and bonding strengths of more than 0.3 $N/mm^2$ can be achieved; this is sufficient for the typical masses of a magnet core, which typically range from roughly 10 to 30 g.

In a specific embodiment, magnet cores of a nanocrystalline alloy of the composition $Fe_{rem}Co_{0.11}Ni_{0.05}Cu_{0.97}Nb_{2.63}Si_{13.1}B_{7.8}Co_{0.18}$ with dimensions of 18.5 mm×13.5 mm×12 mm that were to be fixed were subjected to heat treatment in a continuous furnace for one hour at 538° C. under hydrogen atmosphere and then embedded in a protective housing as shown in FIG. 1. They have a saturation magnetostriction $\lambda_s$ of 4.3 ppm.

FIGS. 2 to 5 show the improvement of magnetic properties of an embodiment of the magnet core described herein that has been achieved by fixing.

Figure 2:
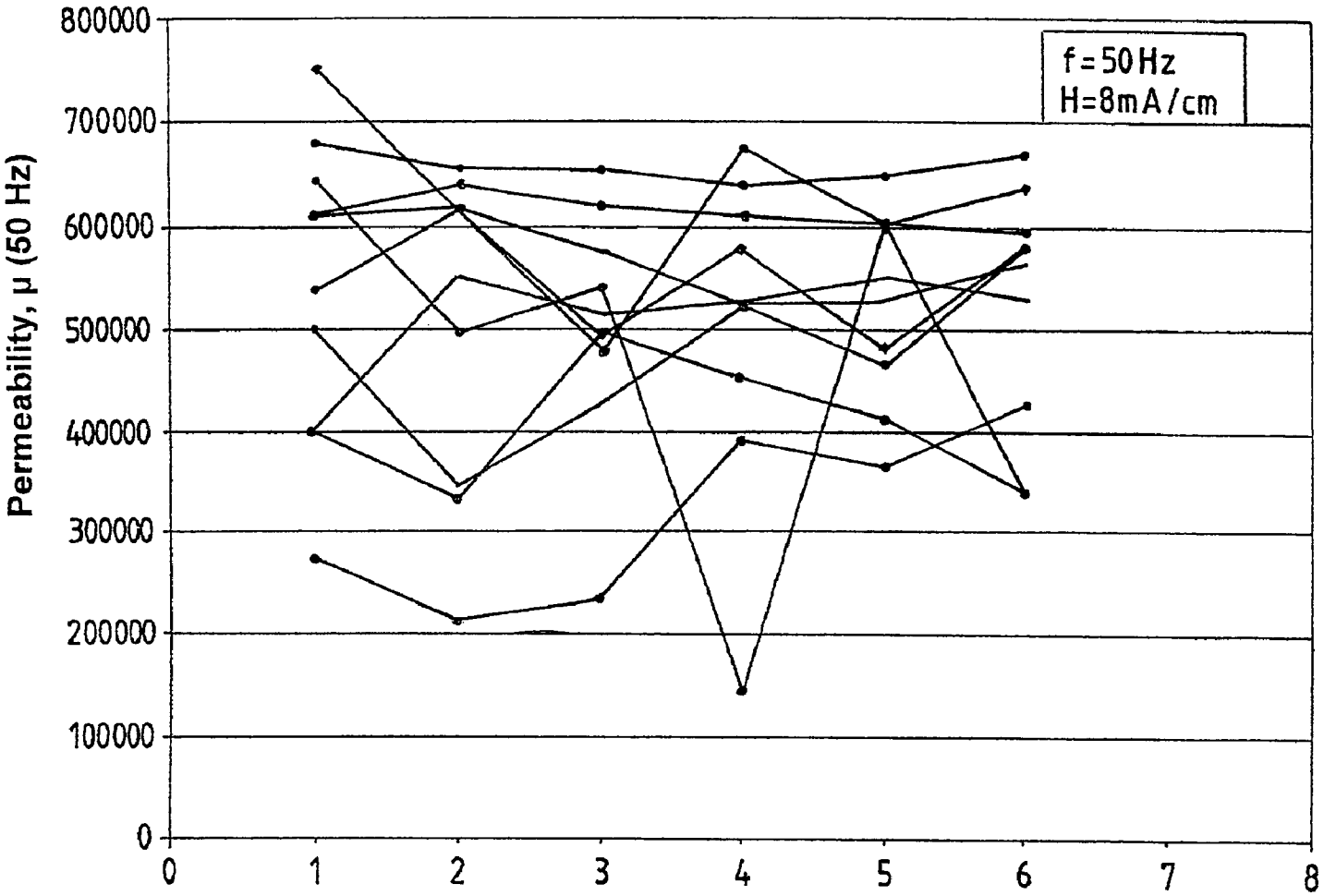
FIG. 2 is a graph that shows the effect of insufficient mechanical stabilization in magnet cores with non-disappearing magnetostriction.

Using a graph, FIG. 2 shows the effect of insufficient mechanical stabilization for magnet cores with non-disappearing magnetostriction according to the prior art. For this purpose, highly permeable magnet cores of quickly solidified nanocrystalline alloys with non-disappearing magnetostriction between two punched disks of a very soft, open-pore foam, such as polyurethane foam, were supported in a plastic housing. The magnet cores protected in this way were allowed to drop from a height of roughly 10 cm onto a hard substrate. After dropping, the magnetic characteristics of the magnet cores such as, for example, their relative permeability at a given field strength, as described in, for example, R. Boll: "Magnetically Soft Materials," 4th Edition, p. 140 ff., were determined. Following the measurement, each magnet core was turned and with its opposite front side was allowed to drop from a height of roughly 10 cm onto the hard substrate. Its magnetic characteristics were determined again, and this drop test was repeated several times.

In FIG. 2, as a result of this drop test, the measured relative permeabilities are plotted over the number of drop processes. As can be recognized in FIG. 2, the relative permeabilities of the magnet cores change unpredictably with the drop processes. This can be explained by the fact that with dropping or impact of the embedded magnet core, due to insufficient stabilization by the foam punched disks, axial displacement of individual band layers or band layer stacks occurs. This mechanical deformation of the magnet core along its lengthwise axis changes the mechanical stress state of the individual band layers and leads to the observed changes in the relative permeability.

Figure 3:
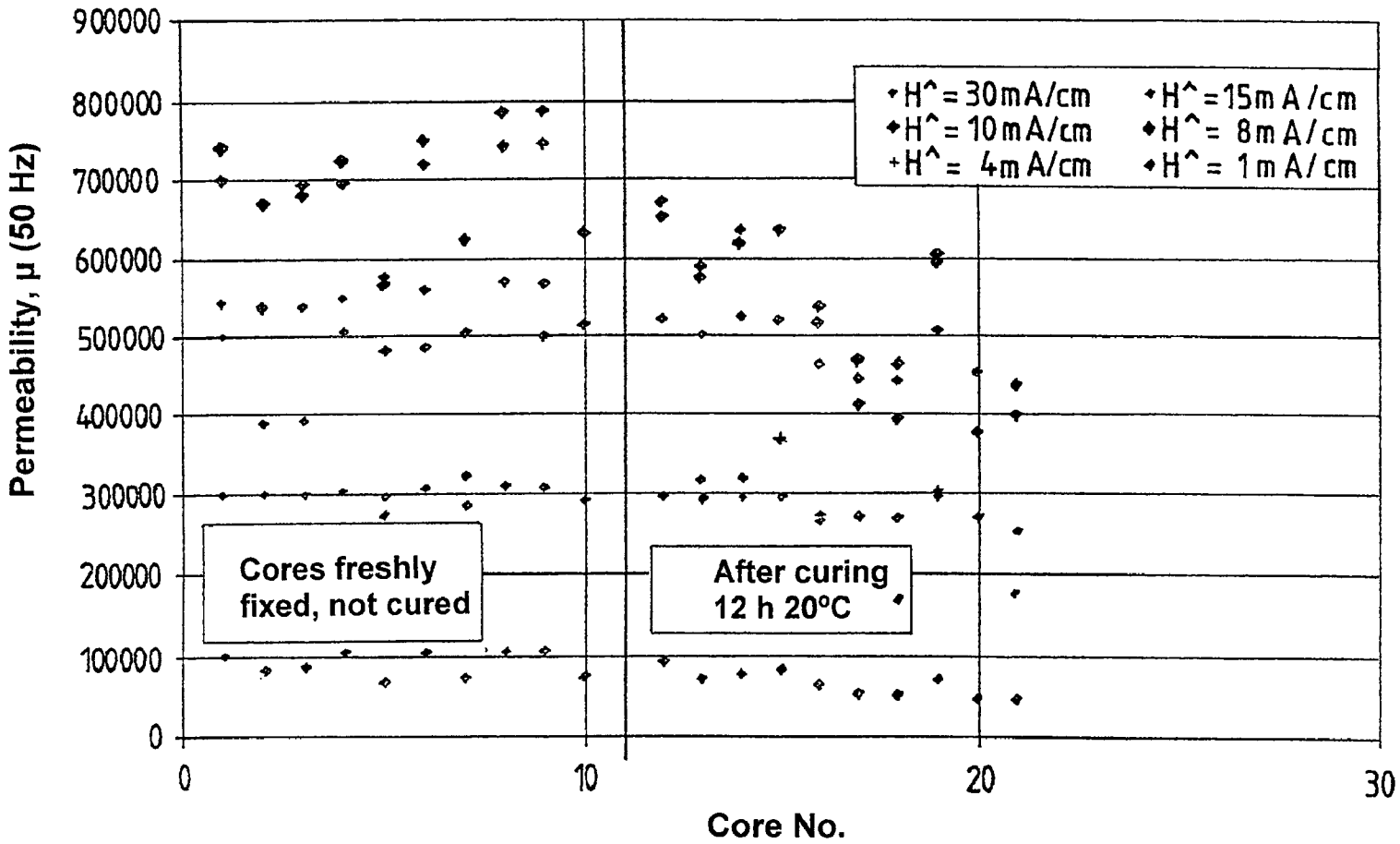
FIG. 3 is a graph that shows the effect of fixing the magnet core with a silicone rubber cement.

Using a graph, FIG. 3 shows the effect of fixing the magnet core with a silicone rubber cement according to the prior art. For this purpose, highly permeable magnet cores according to the method described in EP 0 509 936 B1 were connected to the plastic housing by means of a soft elastic silicone cement by several bonding points. As can be recognized in FIG. 3, the cement causes degradation of the magnetic properties of the magnet cores, especially a reduction of the relative permeability.

For this purpose, in the diagram according to FIG. 3, the relative permeabilities of the magnet cores that was determined at 50 Hz in the freshly cemented state (initial measured values with core numbers up to 10) and in the completely cured state of the cement (subsequent core numbers) were plotted.

The cause of the unwanted reduction of the relative permeability is presumably that the cement masses used in the non-crosslinked state have typical viscosities of between 2 Pa·s and 200 P·s and the time up to the start of curing of the cement by absorbing moisture is between 30 and 120 minutes. During this time, after insertion of the magnet core into the cement drops, the cement mass penetrates between the individual band layers of the magnet core, on the one hand as a result of the capillary forces, and, on the other hand, due to the magnet core's sinking in under its individual weight. During subsequent curing of the cement mass, the volume of the cement mass is reduced, and thus tensile stresses occur on the band layers that are crosslinked with the cement mass. If the core had been inserted only after setting of the cement mass, there would no longer have been any cement adhesion.

The magnet cores according to FIG. 3 had comparatively high band filling factors of 83.4% and thus small defects of form and comparatively low saturation magnetostriction $\lambda_s$ of 2.2 ppm. Nevertheless, the reduction of the relative permeability was roughly 50%. This influence by the cement is, on the one hand, undesirably large and, on the other hand, as can likewise be recognized in FIG. 3, cannot be calculated in its specific level.

Figure 4:
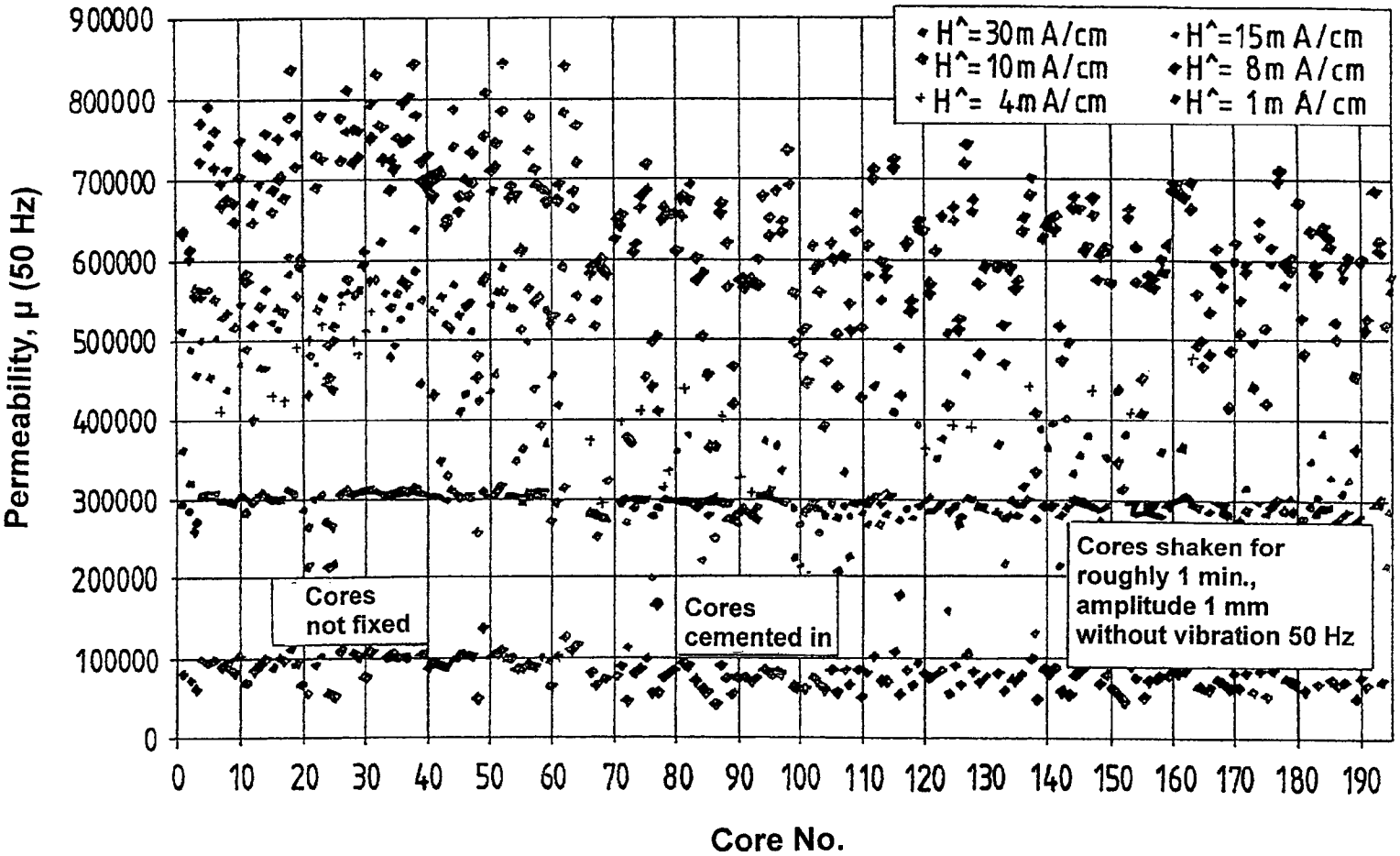
FIG. 4 is a graph that shows the effect of fixing the magnet core according to an embodiment the method described herein with an acrylate contact cement.

Using a graph, FIG. 4 shows the effect of fixing the magnet core according to an embodiment of the method described herein, using an acrylate contact cement. For this purpose, as in the test described in FIG. 3, highly permeable magnet cores according to one embodiment of the invention were cemented with an acrylate contact cement into a plastic housing, an aqueous pure acrylate dispersion having been used.

The cores consisting of a nanocrystalline alloy of composition $Fe_{rem}Co_{0.11}Ni_{0.05}Cu_{0.97}Nb_{2.63}$—$Si13_{0.1}B_{7.8}C_{0.18}$ with dimensions of 18.5 mm×13.5 mm×12 mm that are to be fixed were exposed to heat treatment in a continuous furnace for one hour at 538° C. under hydrogen atmosphere and then embedded in a plastic housing as shown in FIG. 1. Although the saturation magnetostriction $\lambda_s$ with 4.3 ppm was not especially small, irreversible degradation between the unfixed cores (core numbers 1 to 64) and the fixed cores (core numbers 65 to 130) due to mechanical stresses with roughly 12% was much less than for magnet cores of the prior art. A shaking test conducted on the same cores at a frequency of 50 Hz, an amplitude of 1 mm and a duration of one minute likewise did not lead to any noteworthy changes of the characteristics such as the relative permeability of the magnet cores (core numbers starting at 131).

Figure 5:
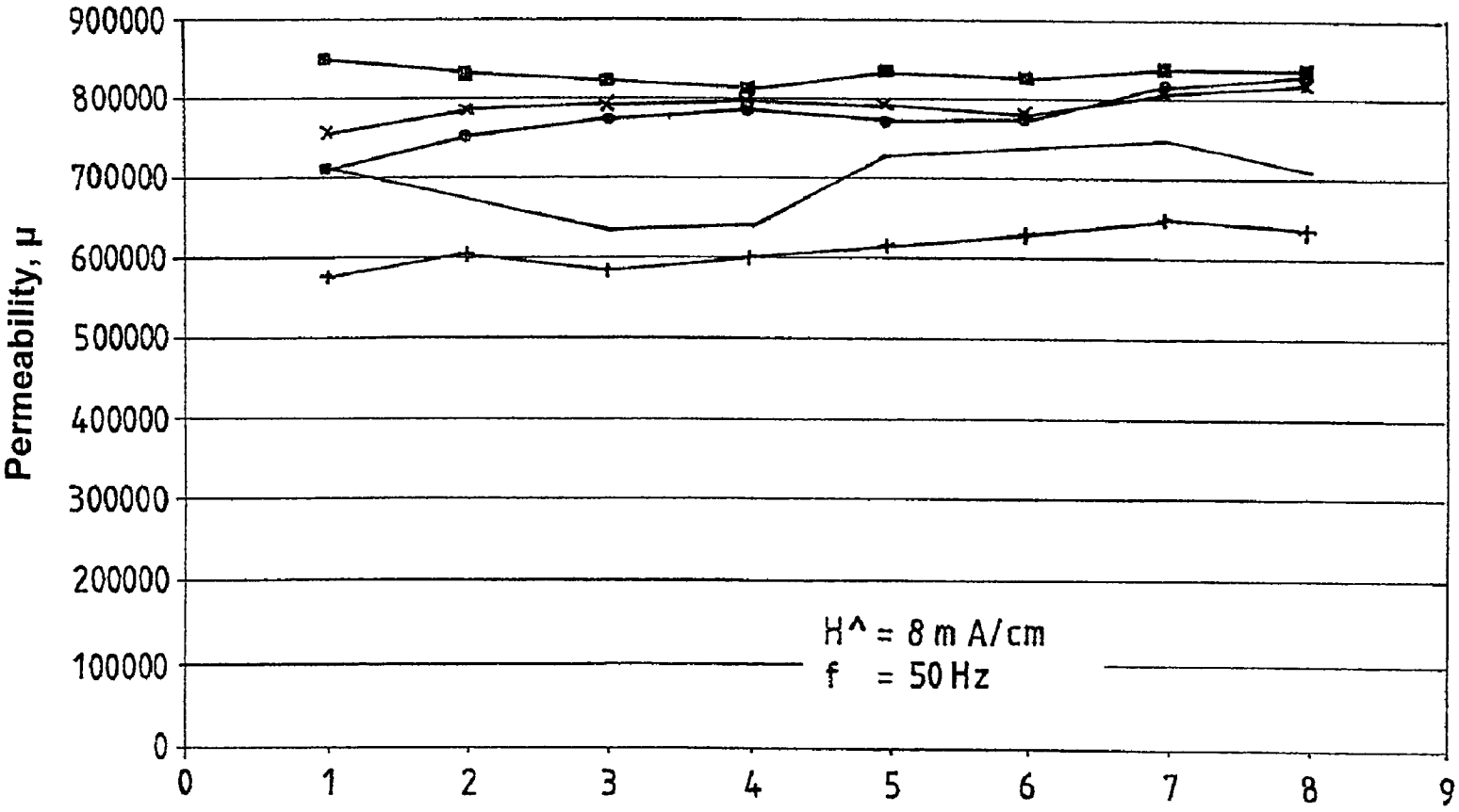
FIG. 5 is a graph that shows the effect of mechanical stabilization of the magnet core according to an embodiment described herein.

The drop test described in conjunction with FIG. 2 also resulted in only a negligible change of the relative permeability of the magnet cores, as is shown in the graph shown in FIG. 5.

The invention having been described with reference to certain specific embodiments and examples, it will be seen that these do not limit the scope of the appended claims.

What is claimed is:

1. A magnet core assembly, comprising:

a magnet core formed from a magnetically soft band that is helically wound to form a plurality of band layers separated by intermediate spaces, and having side surfaces thereof, wherein the magnet core comprises a top and a bottom, wherein the top and the bottom are formed by a side surface of the magnetically soft band;

a protective housing comprising an inside wall disposed around the magnet core, and within which the magnet core is fixed; and a tacky contact cement having an elongation at tear $\epsilon_R$>250% disposed between the bottom of the magnet core and the inside wall of the protective housing for fixing the magnet core therein.

2. The magnet core assembly according to claim 1, wherein the contact cement has an elongation at tear $\epsilon_R$, such that $\epsilon_R$>450%.

3. The magnet core assembly according to claim 2, wherein the contact cement has an elongation at tear $\epsilon_R$, such that $\epsilon_R$>600%.

4. The magnet core assembly according to claim 1, wherein the contact cement has a glass transition temperature $T_g$, such that $T_g$<0° C.

5. The magnet core assembly according to claim 4, wherein the contact cement has a glass transition temperature $T_g$, such that $T_g$<−20° C.

6. The magnet core assembly according to claim 5, wherein the contact cement has a glass transition temperature $T_g$, such that $T_g$<−30° C.

7. The magnet core assembly according to claim 1, wherein the contact cement has a melting point $T_s$, such that $T_s$>180° C.

8. The magnet core assembly according to claim 1, wherein the contact cement comprises an acrylate polymer.

9. The magnet core assembly according to claim 1, wherein the contact cement penetrates into the intermediate spaces up to a penetration depth t, such that t<2 mm.

10. The magnet core assembly according to claim 9, wherein the contact cement penetrates into the intermediate spaces up to a penetration depth t, such that t<0.5 mm.

11. The magnet core assembly according to claim 10, wherein the contact cement penetrates into the intermediate spaces up to a penetration depth t, such that t<0.01 mm.

12. The magnet core assembly according to claim 1, wherein the magnetically soft band is nanocrystalline.

13. The magnet core assembly according to claim 1, wherein the magnetically soft band is crystalline.

14. The magnet core assembly according to claim 1, wherein the magnetically soft band is amorphous.

15. The magnet core assembly according to claim 1, wherein the magnetically soft band consists essentially of the following alloy composition:

$$Fe_aCo_bCu_cSi_dB_eM_fX_g$$

in which M is at least one of the elements V, Nb, Ta, Ti, Mo, W, Zr, and Hf, and X is at least one of the elements P, Ge and C; a, b, c, d, e, f, and g are given in atomic percent, are such that $0 \leqq b \leqq 45$; $0.5 \leqq c \leqq 2$; $6.5 \leqq d \leqq 18$; $5 \leqq e \leqq 14$; $1 \leqq f \leqq 6$; g<5; d+e>16; and a+b+c+d+e+f+g=100, wherein cobalt can be replaced in whole or in part by nickel; and commercially common impurities of raw materials and the melt.

16. The magnet core assembly according to claim 1, wherein the magnet core has a saturation magnetostriction constant $\lambda_s$ of $\lambda_s$<15 ppm.

17. The magnet core assembly according to claim 1, wherein the magnet core has a ratio of remanent induction to saturation induction $B_R/B_S$ such that $B_R/B_S$>45%, and has a maximum permeability $\mu_{max}$ such that $\mu_{max}$>250,000.

18. The magnet core assembly according to claim 1, wherein the magnet core has a ratio of remanent induction to saturation induction $B_R/B_S$ such that $B_R/B_S$>50% and has a maximum permeability $\mu_{max}$ such that $\mu_{max}$>150,000.

19. The magnet core assembly according to claim 1, wherein the magnet core has a ratio of remanent induction to saturation induction $B_R/B_S$ such that $B_R/B_S$>2% and has a maximum permeability $\mu_{max}$ such that $\mu_{max}$>5,000.

20. A method for producing a magnet core assembly according to claim 1, comprising:

providing a magnet core wound from a magnetically soft band to form a plurality of band layers separated by intermediate spaces, and having side surfaces thereof, wherein the magnet core comprises a top and a bottom, wherein the top and bottom are formed by a side surface of the magnetically soft band;

providing a protective housing comprising an inside wall, and adapted for holding the magnet core;

applying a contact cement to the inside wall of the protective housing, wherein the contact cement forms a tacky film on its surface;

inserting the magnet core into the protective housing, such that the bottom of the magnet core contacts and adheres to the contact cement.

21. The method according to claim 20, whereby the contact cement comprises an acrylate polymer.

22. The method according to claim 20, wherein the applying of the contact cement comprises applying an aqueous dispersion of the contact cement to the inside wall of the protective housing.

23. The method according to claim 20, wherein the applying of the contact cement comprises applying an organic solution of the contact cement to the inside wall of the protective housing.

24. The method according to claim 20, wherein the contact cement has a viscosity $\nu$ such that $\nu<20$ Pa·s during the inserting of the magnet core into the protective housing.

25. The method according to claim 20, wherein the contact cement has a solid content of more than 30 percent by weight during the inserting of the magnet core into the protective housing.

26. The method according to claim 20, wherein the contact cement has a minimum film formation temperature $T_F$ such that $T_F<0°$ C.

27. The method according to claim 20, wherein the contact cement has an elongation at tear $\epsilon_R$ such that $\epsilon_R>600\%$.

28. The method according to claim 20, wherein the contact cement has a glass transition temperature $T_g$ such that $T_g<-30°$ C.

29. The method according to claim 20, wherein the contact cement has a melting point $T_s$ such that $T_s=180°$ C.

30. The method according to claim 20, wherein the contact cement penetrates into the intermediate spaces up to a penetration depth t such that t<2 mm.

31. The method according to claim 30, wherein the contact cement penetrates into the intermediate spaces up to a penetration depth t such that t<0.5 mm.

32. The method according to claim 31, wherein the contact cement penetrates into the intermediate spaces up to a penetration depth t such that t<0.01 mm.

33. The method according claim 20, further comprising hot air drying the contact cement after the applying to the inside wall of the protective housing.

34. The method according to claim 20, further comprising infrared drying the contact cement after the applying to the inside wall of the protective housing.

35. The method according to claim 20, wherein the inserting of the magnet core into the protective housing occurs when the contact cement has not yet set under the film on its surface.

36. The method according to claim 20, further comprising heat treating the magnet core before the inserting into the protective housing.

37. The method according to claim 36, wherein said heat treating is done in the absence of a magnetic field.

38. The method according to claim 36, wherein said heat treating is done at a temperature T such that $505° C. \leqq T \leqq 600° C.$

39. The method according to claim 38, wherein said heat treating is done fully or intermittently in a magnetic field.

40. A fault current circuit breaker comprising a magnet core assembly according to claim 1.

* * * * *